United States Patent [19]

Pantanella

[11] 4,071,747

[45] Jan. 31, 1978

[54] DRAWER ILLUMINATING DEVICE

[76] Inventor: Anthony C. Pantanella, 1215½ W. Ash St., Springfield, Ill. 62703

[21] Appl. No.: 726,674

[22] Filed: Sept. 27, 1976

[51] Int. Cl.[2] ..... A47B 97/00

[52] U.S. Cl. ..... 362/127; 312/223

[58] Field of Search ..... 240/4, 6; 312/223, 333; 70/85

[56] References Cited

U.S. PATENT DOCUMENTS

| | | | |
|---|---|---|---|
| 674,171 | 5/1901 | Kumber | 292/DIG. 73 |
| 1,906,131 | 4/1933 | Baylis | 240/4 |
| 2,448,080 | 8/1948 | Cobbs | 240/4 |

*Primary Examiner*—William H. Beha, Jr.
*Attorney, Agent, or Firm*—Robert D. Farkas

[57] ABSTRACT

A drawer illuminating device utilizing a housing having a pair of compartments therein. One compartment houses a lamp which provides illumination passing through a transparent sheet-like lens covering a portion of the lamp compartment. The other compartment includes a battery and a normally closed switch. A switch operating lever passes through the housing and maintains the lamp in an un-energized state when the drawer, to which the housing is secured, is in a closed position. A bar is pivotably secured to the housing and is biased in a preferred direction, preventing the drawer from being opened by small children and accidentally causing the lamp to energize when the operating lever ceases to contact portions of the frame surrounding the drawer.

5 Claims, 3 Drawing Figures

DRAWER ILLUMINATING DEVICE

BACKGROUND OF THE INVENTION

1. The Field of the Invention

This invention relates to illuminating devices and more particularly to that class adapted with an internal power source for mounting inside the drawer of a chest.

2. Description of the Prior Art

The prior art abounds with automatic operated lamps for doors and cabinets. U.S. Pat. No. 1,906,131 issued on Apr. 25, 1933 to G. A. Baylas teaches a battery light for refrigerators, ice boxes, closets and the like, having a housing. A pair of batteries, a lamp, and a switch are disposed within the housing. The switch has an operating lever extending outwardly from the housing which in the undepressed state, causes the switch contacts to be closed, illuminating the lamp.

U.S. Pat. No. 2,448,080 issued on Aug. 31, 1948 to E. R. Cobbs discloses a lamp and switch arrangement disposed within a transparent housing having an operating lever energizing the lamp when the portion of the lever extending outwardly from the housing is released.

Both of the aforementioned patents suffer the common deficiency of failing to provide a mechanism capable of restraining the door panel or drawer face operated in conjunction with the lighting apparatus, from being opened by unauthorized personnel such as small children. Such openings of the enclosures utilized in conjunction with the lighting apparatus would rapidly deteriorate the battery power supply used to energize the lamp.

SUMMARY OF THE INVENTION

A primary object of the present invention is to provide an illuminating source for the interior of a drawer, energizable when the drawer is withdrawn outwardly from the chest or cabinet slideably supporting the drawer.

Another object of the present invention is to provide a detachable lever to the lamp apparatus which causes a restraining force to be exerted upon the drawer opposing an unauthorized applied opening force.

Still another object of the present invention is to provide a simple and inexpensive mounting means for securing the apparatus to the interior frontmost vertical surface of a drawer.

Yet another object of the present invention is to provide an apparatus which permits the lever to be detached easily and conveniently in those installations wherein the likelihood of unauthorized opening of the drawer is remote.

A further object of the present invention is to provide an apparatus in accordance with the preceding objects, which is simple in construction, relatively inexpensive, and effective for its particular purposes.

Heretofore, battery operated illuminating devices have been disclosed utilizing an operating lever which applied an opening force to a panel or door, which when opened, caused the light source thereof to become energized. Since the apparatus utilized a spring biased force to urge the operating lever in a direction to open the access panel or door, small manually applied forces, supplementing the spring force, caused the door to be easily opened. The present invention provides a bar which tends to restrain the opening of the door or more particularly to limit the ease in which a drawer may be withdrawn from the cabinet or case slideably carrying the drawer. Furthermore, the present invention utilizes an operating lever which is disposed travelling at right angles to the direction of travel of the drawer thereby eliminating any tendency for the drawer to be disposed in a pulled out position because of a spring bias force applied to the operating lever.

These objects as well as other objects of the present invention will become more readily apparent after reading the following description of the accompanying drawings.

DESCRIPTION OF THE PREFERRED EMBODIMENT

Figure 1:
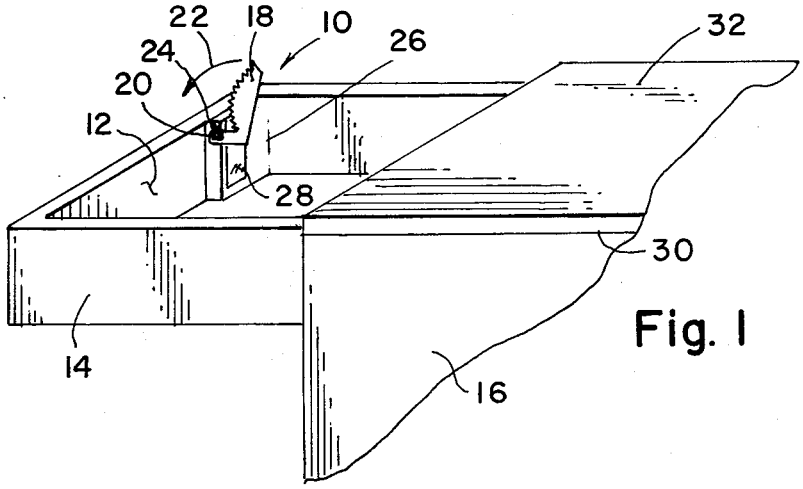
FIG. 1 is a perspective view of the present invention shown mounted in a drawer of a cabinet.

The structure and method of fabrication of the present invention is applicable to a housing having a first lateral surface to which is affixed an adhesive layer covered by a peelable barrier sheet. The housing contains a pair of compartments. One compartment contains an illuminating lamp and has an access port thereof removably covered by a transparent plastic lens. The lens may be fabricated from an acrylic plastic material residing in conventional fashion, in grooves disposed within the marginal edges of the opening. The other compartment contains a battery removably secured within a conventional battery mounting clip and a normally closed momentary switch. The terminals of the lamp, switch and battery are connected in a series electrical circuit. The lamp is secured within a socket secured to the wall intermediate the two compartments. An operating lever controls the operation of the switch and extends outwardly from the housing so as to have a direction of travel along a line parallel to a plane defined by the surface carrying the adhesive sheet. A shaft is journaled within the housing and has an extending portion passing outwardly from the housing. The axis of rotation of the shaft is parallel to the plane of the housing carrying the adhesive and perpendiclar to the line of travel of the operating lever of the switch. The extending portion of the shaft has a rectangular cross-section. The shaft is biased to rotate in a preferential direction, utilizing a helical spring therefor. One end of the spring resides in touching engagement with the interior of the housing. The other end of the spring is secured to the shaft. A bar having a rectangular hole passing therethrough may be removably attached to the extended outermost portion of the shaft, such that the bar protrudes radially outwardly from the shaft and is pivoted about the axis of rotation of the shaft whenever the shaft rotates. Thus, the angular translation of the bar defines a plane perpendicular to the plane of the surface of the housing carrying the adhesive and perpendicular to the axis of rotation of the shaft. An outermost end of the bar, distantmost from the axis of rotation of the shaft, is urged towards the plane of the surface of the housing, adjacent to the side of the housing through which the operating lever of the switch passes, by the action of the spring.

The peelable barrier sheet, after being removed from the layer of adhesive, permits the housing to be securely attached to an interior frontmost vertical surface of a drawer. The switch operating lever engages an overhead portion of a drawer frame of a chest or cabinet when the drawer is closed. When the drawer is opened, the operating lever is free is extend upwardly so as to complete the electrical circuit and energize the lamp. The bar, when installed on the outermost extended portion of the shaft, is caused to rotate upwardly and towards the drawer mounting surface of the housing. A portion of the bar is caused to contact the overhead drawer frame portion of the cabinet so as to cause the drawer to be maintained in a closed position. A moderate force applied to the drawer so as to pull the drawer outwardly from the chest must be of sufficient magnitude to overcome the drawer closing force applied to the bar by the helical spring eliminating or limiting the possibility of unauthorized opening of the drawer by small children.

Now referring to the figures, and more particularly to the embodiment illustrated in FIG. 1 showing the present invention 10 shown mounted to the interior frontmost vertical surface 12 of a drawer 14. Cabinet 16 slideably supports drawer 14, shown in a partially withdrawn position. Bar 18 is shown supported on rectangular shaft 20 such that the free end of the bar may move in the direction of arrow 22. Stop pin 24 is shown extending outwardly from housing 26 limiting the amount of travel of the free end of bar 18. Transparent lens 28 permits light rays, not shown, emanating from the interior of housing 26, to illuminate the interior of drawer 14. Bar 18 may be manually operated in a direction opposite to arrow 22 so as to permit the free end of bar 18 to pass below the lowermost surface 30 of sheet 32 comprising the uppermost surface of cabinet 16.

Figure 2:
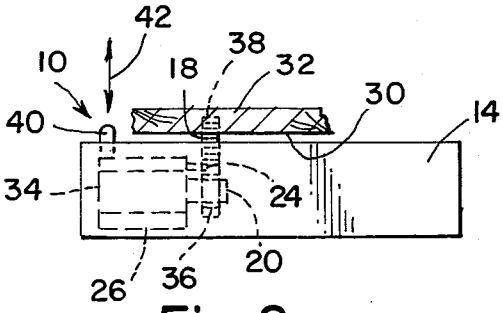
FIG. 2 is a partial front elevation view of the drawer and the cabinet including the present invention mounted thereto.

FIG. 2 shows drawer 14 to which is affixed housing 26. Adhesive layer 34 joins together housing 26 and frontmost vertical surface 12 of the drawer, as shown in FIG. 1. Adhesive layer 34 may be provided with a peel-off barrier sheet prior to the installation of the present invention to the interior surface of the drawer. Rectangular shaft 20 is shown carrying bar 18 by passing through a complementary opening 36 in the bar. The free end 38 of the bar is shown engaging a portion of sheet 32 of the cabinet. An operating lever 40 extends outwardly and upwardly from housing 26 and may travel in the directions of arrows 42 when in touching engagement with and when free from touching engagement with surface 30 of sheet 32. Stop pin 24 limits the rotational travel of free end 38 of bar 18.

Figure 3:
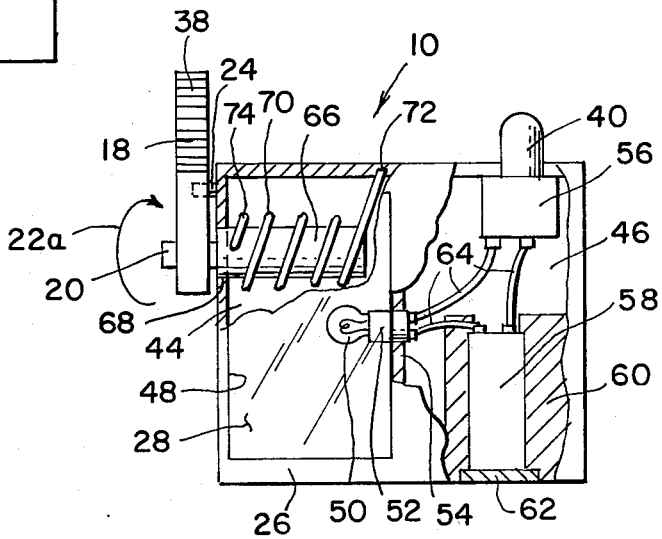
FIG. 3 is a rear elevation view of the present invention.

FIG. 3 illustrates housing 26 having a first compartment 44 and a second compartment 46 therewithin. Transparent lens 28 covers an opening 48 within the first compartment. Lamp 50 is mounted within socket 52 secured to wall 54 separating compartments 44 and 46. Switch 56 is mounted within compartment 46. Battery 58 is mounted within a battery clip 60. The battery may be accessed by removing cover 62. Wires 64 interconnect the terminals of switch 56, battery 58 and lamp 50 into a series of electrical circuit. Operating lever 40 extends upwardly and outwardly from housing 26, Shaft 66 is journaled to the housing at point 68 and is caused to rotate in the direction of arrow **22*a* by the action of spring 70. End 72 of spring 70 is in touching engagement with the interior surface of compartment 44. End 74 of spring 70 is fixedly secured to shaft 66 by passing through a hole therein. Outwardly extending portion 20 of shaft 66 carries bar 18 slideably and removably engaged thereupon. Stop pin 24 limits the degree of travel of free end 38 of bar 18**.

One of the advantages of the present invention is an illuminating source for the interior of a drawer, energizable when the drawer is withdrawn outwardly from the chest or cabinet slideably supporting the drawer.

Another advantage of the present invention is a detachable lever to the lamp apparatus which causes a restraining force to be exerted upon the drawer opposing an unauthorized applied opening force.

Still another advantage of the present invention is a simple and inexpensive mounting means for securing the apparatus to the interior frontmost vertical surface of a drawer.

Yet another advantage of the present invention is an apparatus which permits the lever to be detached easily and conveniently in those installations wherein the likelihood of unauthorized opening of the drawer is remote.

A further advantage of the present invention is an apparatus in accordance with the preceding advantages, which is simple in construction, relatively inexpensive, and effective for its particular purposes.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not be the specific disclosure herein, but only by the appending claims.

I claim:

1. A drawer illuminating device comprising a housing having a pair of compartments therein, a transparent lens removably secured to the housing covering an opening communicating to one of the compartments, a lamp having terminals, a socket, the lamp being removably secured within the socket, the lamp having a light emitting portion disposed in said one compartment, a battery having terminals, a switch having terminals, the terminals of the battery and the terminals of the switch and the terminals of the lamp being disposed in a series electrical circuit, the battery being removably secured within the other compartment, the switch being fixedly secured with the other compartment, the switch having an operating lever extending outwardly from said other compartment, the switch having normally closed contacts connecting to the terminals thereof, a bar, a shaft, a portion of the shaft extending outwardly from the housing and journaled thereto, means to bias the shaft about the axis of rotation thereof, the bar having a hole, the extended portion of the shaft beinb disposed removably engaged within the hole, the bar extending radially outwardly from the shaft and rotatable therewith when the bar is carried by the extended portion of the shaft, means to secure the housing to an interior vertical surface of a drawer.

2. The drawer illuminating device as claimed in claim 1 wherein said bias means comprises a helical spring, one end of the spring being disposed in touching engagement with the housing, the other end of the spring being fixedly secured to the shaft.

3. The drawer illuminating device as claimed in claim 1 wherein said securing means comprises a sheet of adhesive material having opposed lateral surfaces, one of the opposed lateral surfaces being disposed fixedly secured on an exterior surface of the housing, a sheet of barrier material removably secured to the other of the opposed lateral surfaces.

4. The drawer illuminating device as claimed in claim 1 further comprising a pin, the pin extending outwardly from the housing being disposed adjacent and parallel to the extended portion of the shaft, the pin limiting the angular rotation of the bar about the axis of rotation of the shaft.

5. The drawer illuminating device as claimed in claim 1 wherein the extended portion of the shaft has a rectangular cross-section, and the hole has a complementary rectangular cross-section.

* * * * *